United States Patent [19]

Cooper

[11] 3,993,394

[45] Nov. 23, 1976

[54] CONNECTOR HALF HAVING CONNECTOR WAFER RETAINED THEREIN

[75] Inventor: James Brand Cooper, Los Altos, Calif.

[73] Assignee: Raychem Corporation, Menlo Park, Calif.

[22] Filed: Dec. 17, 1975

[21] Appl. No.: 641,486

Related U.S. Application Data

[63] Continuation of Ser. No. 493,392, July 31, 1974, abandoned.

[52] U.S. Cl. ..... 339/136 M; 339/217 S

[51] Int. Cl.[2] ..... H01R 13/42

[58] Field of Search ..... 339/59 R, 59 M, 136 R, 339/136 M, 217 S

[56] References Cited

UNITED STATES PATENTS

| | | | |
|---|---|---|---|
| 3,079,580 | 2/1963 | Paasche | 339/136 R |
| 3,182,278 | 5/1965 | Bridle | 339/59 M |
| 3,634,811 | 1/1972 | Teagno | 339/217 S X |
| 3,727,172 | 10/1973 | Clark | 339/59 M |
| 3,808,578 | 4/1974 | Hansen | 339/217 S X |

*Primary Examiner*—Joseph H. McGlynn
*Assistant Examiner*—Howard N. Goldberg
*Attorney, Agent, or Firm*—Lyon & Lyon

[57] ABSTRACT

In a connector half, substantially parallel transverse walls joined by perpendicular sides to provide a substantially rectangular cross-section to receive at least one flat connector wafer inserted therein in a forward axial direction. A transverse rib is formed on an upper face of a wafer facing an inner face of a transverse wall. A spring clip cantilevered of the inner face of the connector half is provided. When the wafer is inserted in the connector half, the rib acts as a cam against the spring clip, forcing the spring clip up. The spring clip returns to abut the rear of the rib as the wafer is pushed into position to retain the wafer in the connector half. The rib may be provided with recess for meshing with axial keys on the inner surface of the connector half. A tool is provided for camming the spring clip and allowing removal of the wafer.

9 Claims, 17 Drawing Figures

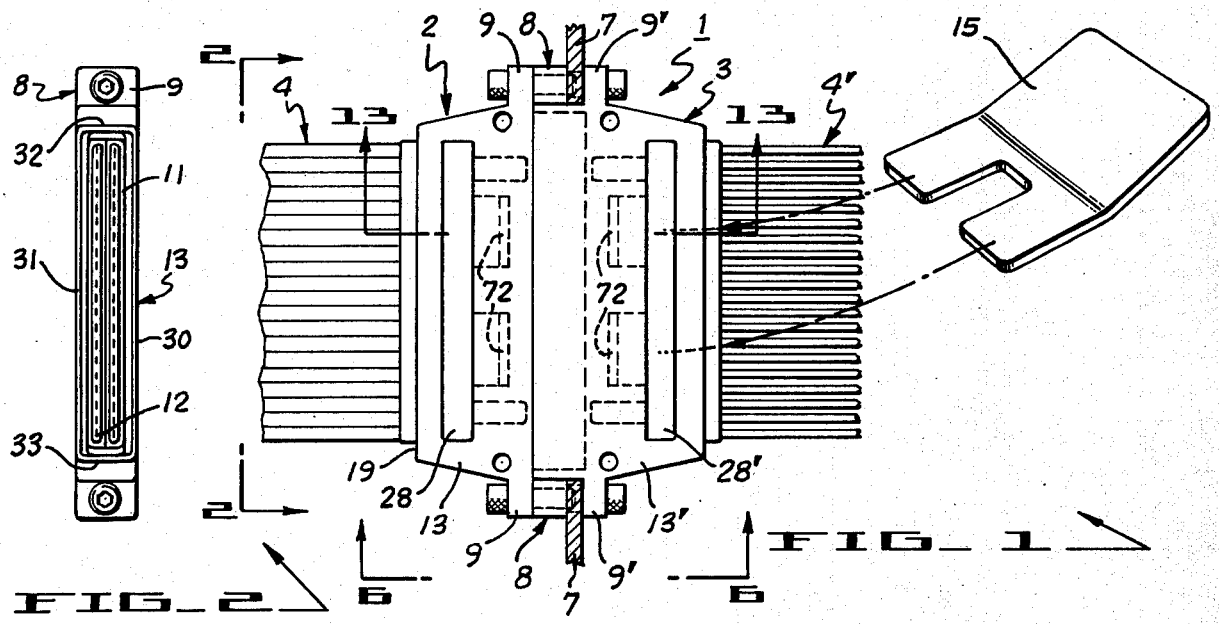
FIG_1
FIG_2
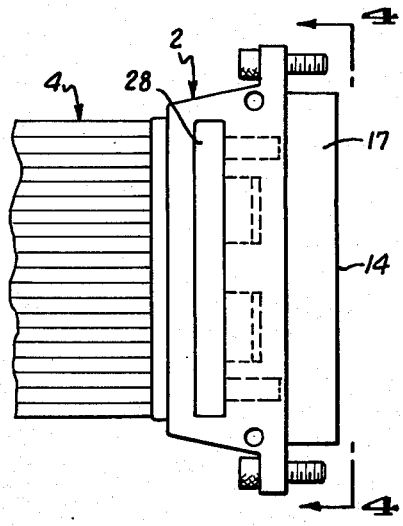
FIG_3
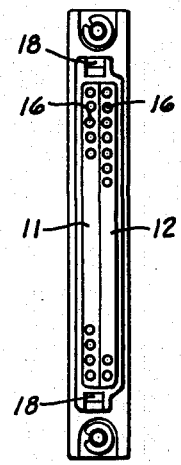
FIG_4
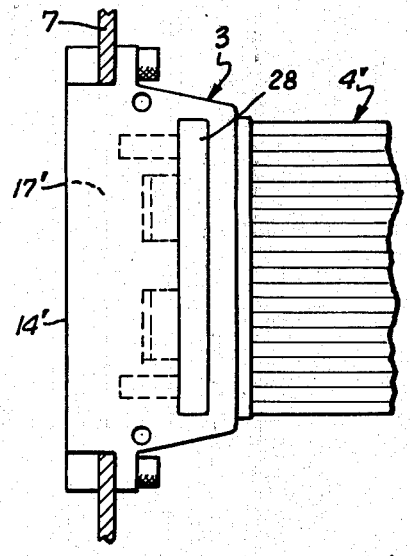
FIG_5
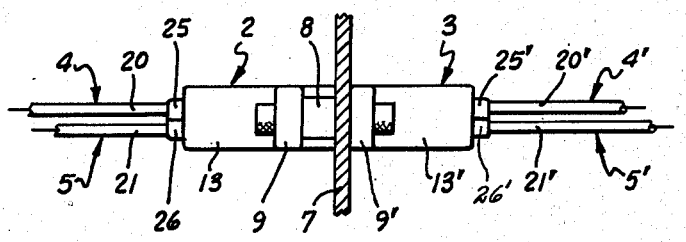
FIG_6

FIG_7
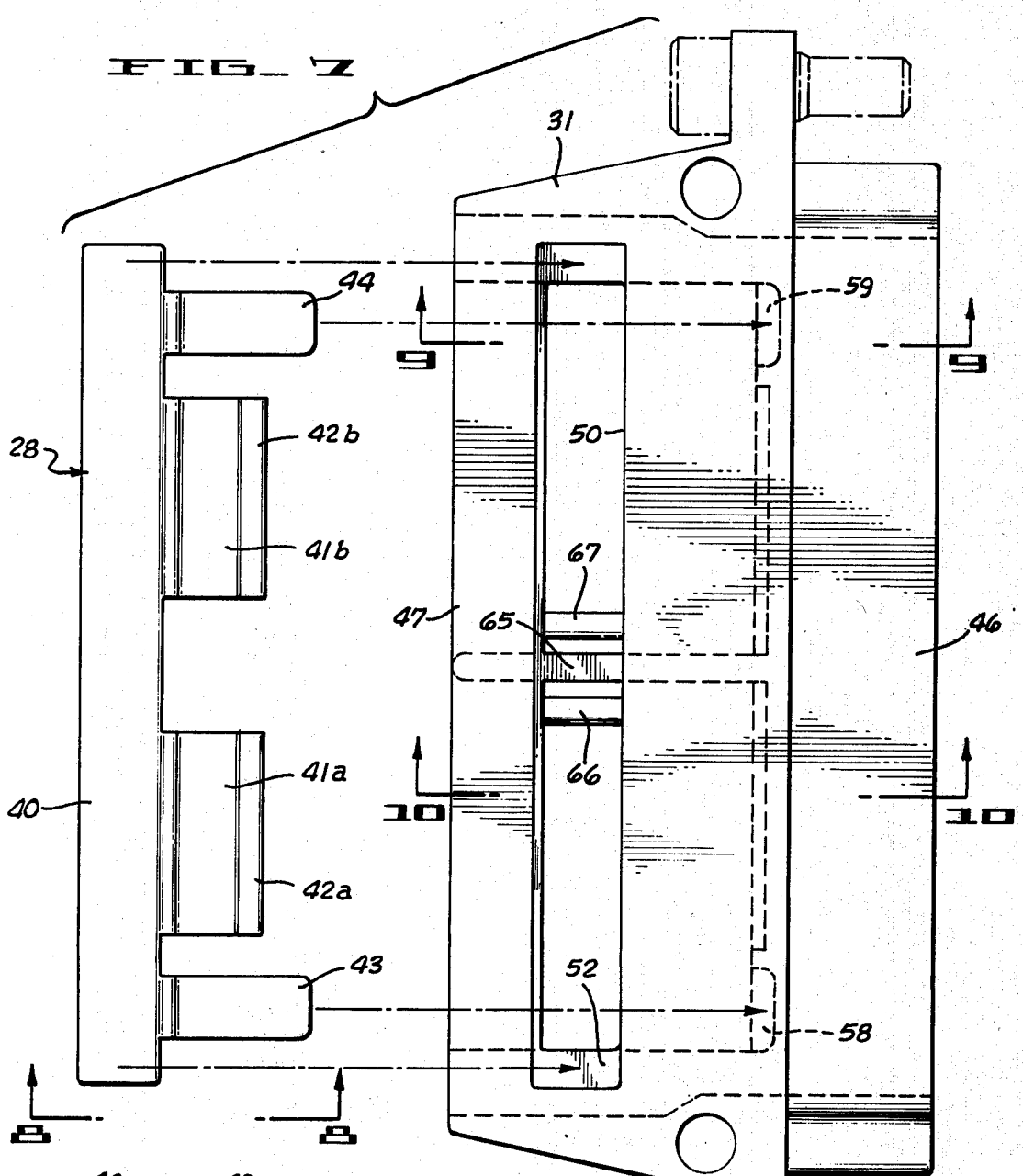
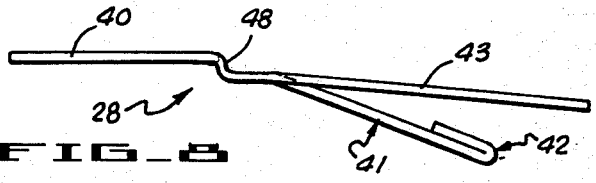
FIG_8
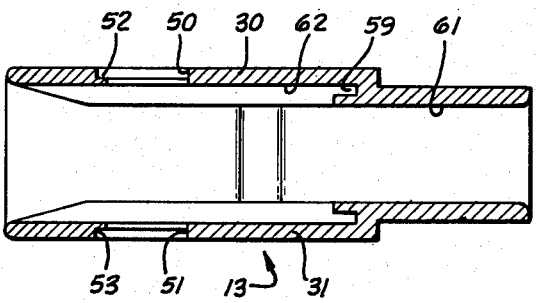
FIG_9
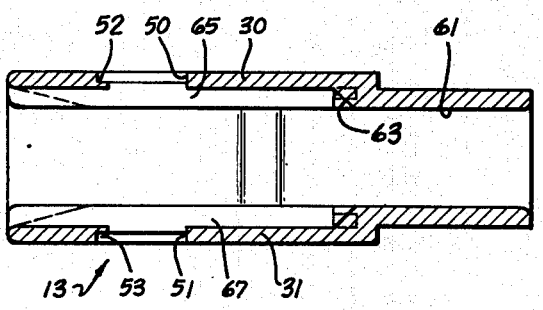
FIG_10

CONNECTOR HALF HAVING CONNECTOR WAFER RETAINED THEREIN

This is a continuation of application Ser. No. 493,392, filed July 31, 1974, now abandoned.

BACKGROUND OF THE INVENTION

This invention relates to electrical connectors, and more particularly to a connector half including improved means for retaining a connector wafer therein.

A connector half is a housing, generally housing at least one connector wafer therein for connection to another connector half or to a connector panel. One form of connector housing is of generally rectangular cross section having parallel transverse faces joined at perpendicular sides. A wafer is inserted therein in an axial direction to form the connector half assembly. The wafer is typically a flat, rigid plastic insert with contacts assembled or molded therein. The contacts may be either pins or sockets extending in the axial direction. In an assembled connector, the contacts ends define a plane perpendicular to the transverse faces of the connector shell at the forward end therof for mating with other contacts. (In order to facilitate assembly of connector halves, it has been necessary to provide a means for holding wafers in a connector shell.) This has been done in the past, for example, by providing a bracket and fastener at the rear of a shell. This involves complex assembly steps. A metallic shell has been provided with spring clips mounted for rotation in the transverse plane for engaging the rear surface of wafers after they are axially inserted in the shell. Such designs entail complexity in construction, and generally require a metallic shell that cannot be formed by a simple casting process. Both forms of connector require a relatively complex form of manipulation to remove the wafer from the back shell.

SUMMARY OF THE INVENTION

It is therefore a general object of the present invention to provide improved means for retaining a connector wafer in a connector shell to provide improved connector assembly and disassembly.

It is a more specific object of the present invention to provide retaining means cantilevered within a connector shell and a rib on a wafer which acts as camming means on the retaining means when the wafer is inserted in the shell and which wafer is rigidly kept in place by the retaining means thereafter.

It is also an object of the present invention to provide a connector assembly of the type described in which the rib on the wafer cooperates with alignment keys as well as acting as retaining means.

It is further an object of the present invention to provide a connector assembly of the type described to provide maximum facility in use while having a small number of parts.

It is another object of the present invention to provide a connector of the type described which can be constructed of metallic parts for maximum strength.

It is a further object of the invention to provide a connector of the type described including structure for keying a wafer to a shell, providing retaining means and utilizing a shell of a construction which may be achieved by a simple casting operation, whereby the need for complex machining in production of the connector assembly is eliminated.

It is still another object of the present invention to provide a connector assembly in which one or more wafers are reliably and strongly maintained in a shell but which may be easily removed when desired.

It is also a specific object of the present invention to provide a tool for use in connection with the above-described connector assembly for removal of the wafer which tool is extremely simple in construction and which is simple to use.

Briefly stated, in accordance with the present invention there is provided that a connector assembly including a connector shell of the generalized type having a rectangular cross section, parallel transverse walls joined by perpendicular side walls for receiving a connector wafer inserted from the rear toward the front in an axial direction. Retaining means cantilevered from an area djacent the rear of the connector shell in an axial direction toward the front are provided. A transverse rib is provided on the connector wafer. When the wafer is inserted into the connector shell, the rib cams the retaining means, slides past the retaining means, and the retaining means bears against the rear shoulder of the rib for retaining the wafer in place. A tool may be provided for camming the retaining means such that the tool and wafer may be removed from the shell when it is desired to disassemble the connector assembly.

BRIEF DESCRIPTION OF THE DRAWINGS

The means by which the foregoing objects and features of novelty are achieved are pointed out with particularity in the claims forming the concluding portion of the specification. The invention, both as to its organization and manner of operation, may be further understood by reference to the following description taken in connection with the following drawings.

Of the drawings:

FIG. 1 is an elevation of an electrical connection formed at 9 panel by first and second connector halves constructed in accordance with the present invention;

FIG. 2 is a cross-sectional view taken along section lines 2—2 of FIG. 1 illustrating a rear view of a connector of FIG. 1;

FIG. 3 is an elevation of one connector assembly of FIG. 1;

FIG. 4 is a view taken along lines 4—4 of FIG. 3, which is an elevation of one connector half assembly FIG. 1;

FIG. 5 is an elevation of the second connector half FIG. 1;

FIG. 6 is a plan view of FIG. 1 taken along section lines 6—6 of FIG. 1;

FIG. 7 is an exploded view of the apparatus of a connector shell and retaining means;

FIG. 8 is an illustration of a spring retaining means according to FIG. 7 taken along section lines 8—8 of FIG. 7;

FIG. 9 is a sectional view taken along lines 9—9 of FIG. 7 illustrating spring retaining slots in a connector shell;

FIG. 10 is a sectional view taken along lines 10—10 of FIG. 7 illustrating keys in a connector shell;

DESCRIPTION OF THE PREFERRED EMBODIMENTS

Figure 13:
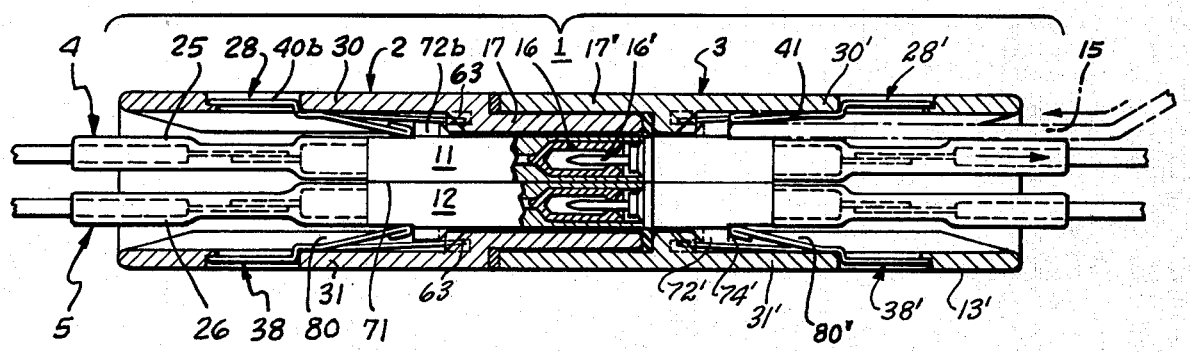
FIG. 13 is a sectional plan view of a connection between two connector halves taken along lines 13—13 of FIG. 1 and further illustrates the use of a wafer removal tool.

Referring now to FIG. 1 and FIG. 6, there is illustrated a connector 1 consisting of first and second connector halves 2 and 3 which are joined to form an electrical and mechanical connection between conductor groups 4 and 5 (the latter shown in FIG. 6) and conductor groups 4′ and 5′ (the latter shown in FIG. 6) which are terminated in the connector halves 2 and 3 respectively. The connection system 1 is mounted in a wall 7 by fastening means 8 Flanges 9 and 9′. The connection system 1 may also be provided for mounting on a surface other than a wall, or may simply consist of the connector halves 2 and 3. The following description is directed primarily toward the connector half 2, and the connector half 3 is similarly constructed. In accordance with the present invention, an improved connector half 2 is provided in which first and second connector wafers 11 and 12 (FIG. 2) are retained in an improved manner in a connector shell 13, comprising the housing in the connector half 2. Additionally, due to the construction of the present invention, a tool 15 (FIG. 1) may be utilized for easy removal of connector wafers 11 and 12 (see FIG. 13) from the connector half 2 or connector wafers 11′ and 12′ from the connector half 3. Primed reference numerals denote components of the connector half 3 corresponding to those of the connector half 2.

FIGS. 3 and 5 individually represent the connector halves 2 and 3 respectively, separated from each other. As seen in FIG. 3, the connector wafers 11 and 12 extend within the connector shell 13 toward a front end 14 thereof in a direction which is referred to as axial. FIG. 4 is a frontal end view of FIG. 3, and illustrates connector pins 16 which are included at front ends of the wafers 11 and 12 for connection to connector pin 16′ in wafers 11′ and 12′ of the connector shell 3 (FIG. 13). The connector shell 13 of the connector half 2 houses forward portions of the connector wafers 11 and 12 in a front section 17 of the connector half 2 which fits in a front section 17′ in the connector half 3. The connector pins 16 may either be pins or sockets, for example pins being included in a wafer 12 of the first connector half 2 or 3, and sockets being included in the wafer 12′ with which the connector wafer 12 mates. Polarizing pins 18 may be provided at the front end 14 of the connector shell 13 for proper relative orientation of the connector halves 2 and 3. The connector shell 13 has a rear end 19.

FIG. 6 is a plan view of the connector halves 2 and 3 mated through a hole in the wall 7. It is of interest to note that the conductor groups 4 and 5 may comprise first and second flat cables 20 and 21, respectively joined by known means to the wafers 11 and 12, each conductor of the flat cables 20 and 21 being terminated to a pin 16 at a front end of a wafer 11 or 12. The groups of conductors 4′ and 5′ could if desired be well-known round wire conductors, each individually terminated to a wafer 11′ and 12′. Alternatively the conductor groups 4′ and 5′ may consist of flat cables 20′ and 21′. For this reason, round wire conductors are shown in FIG. 1, and a flat cable is shown in FIG. 5. The conductor groups 4 and 5 are joined to the wafers 11 and 12 respectively. Each of the termination means 25, 26, 25′ and 26′ (as seen further in FIGS. 11 and 13) may consist of conductor wire-connector pin interfaces and insulation. In FIG. 1, as a rectangular insulation mass surrounding a rear end of the connector wafer 11 and a forward end of the conductor group 4.

The invention is briefly summarized with respect to FIG. 1, prior to a detailed description below. The connector shell 13 has an improved construction which houses a wafer retaining means 28. The wafer retaining means 28 interact with a transverse rib also seen in FIG. 11 formed on an upper surface of the connector wafer 11 for simplified insertion of the connector wafer 11 in the connector shell 13 and for reliable retention thereof. The connector wafer 11 simply removed by use of the tool 15. The connector wafer 12 interacts similarly with the connector shell 13, and the connector wafers 11′ and 12′ interact similarly with the connector shell 13′.

The vertical direction of FIGS. 1 and 7 is referred to as the transverse direction, and the horizontal direction in FIGS. 1 nd 7 is the axial direction. These directions correspond to directions described in the movements of the conductor groups 4 and 5 when the connector wafers 11 and 12 are inserted in the connector shell 13. It is seen in FIG. 2 that the connector shell 13 includes first and second parallel transverse walls 30 and 31. Opposite ends of the parallel transverse walls 30 and 31 are joined respectively by perpendicular walls 32 and 33 such that the connector shell 13 has a substantially rectangular cross section.

Referring to FIG. 7, which is an exploded view of the retaining means 28 removed from the connector shell 13, the wafer-retaining means 28 is viewed in greater detail. The wafer retaining means 28 is illustrated in a plan view in FIG. 8. In FIG. 13, which will be discussed in greater detail below, the wafer retaining means 28 is illustrated mounted in the wall 30 or the connector shell 13, and a wafer-retaining means 38 is mounted in the wall 31. Similarly, wafer-retaining means 28′ and 38′ may be included in walls 30′ and 31′ of the connector half 3. Again referring to FIG. 7 the wafer-retaining means 28 may, in the preferred embodiment, consist of a spring clip including a first transverse leg 40 for seating in the transverse wall 30 and for having other legs depending thereform. A second leg 41 is cantilevered forwardly and downwardly from the transverse leg 40. The term cantilevered is used to denote that one end of the leg 41 is mounted to the connector shell 13. The second leg 41 may be bifurcated, having sections 41*a* and 41*b*, collectively referred to as the second leg 41. By forwardly it is meant that the second leg 41 extends from the leg 40 toward the front end 14 of the connector shell 13. Downwardly means away from a wall to which a retaining leg is mounted. The second leg 41 may be of any convenient transverse width which is less than that of the first leg 40. The sections 41*a* and 41*b* are preferably symmetrical with respect to an axial center line (not shown) in the transverse center of the first leg 40. As seen in FIG. 8, the second leg 41 may have a front portion 42, the sections 41*a* and 41*b* respectively having front portions 42*a* and 42*b*, which is reinforced by any convenient means, such as by folding back an end of the stamping from which the leg is cut back on itself. Additionally, forwardly directed mounting legs 43 and 44 respectively extend from positions adjacent opposite transverse ends of the first leg 40. The wafer retaining means 38 is similarly constructed and disposed in a manner similar to the wafer retaining means 28 as described below. A longitudinal (perpendicular to transverse and axial) offset leg 48 may be provided between the first and second legs 40 and 41.

The connector shell 13 has a forward portion 46 comprising the portion of the connector shell including and generally adjacent to the front end 17 of the connector shell 13, and a rear portion 47 in which the first leg 40 is mounted. As seen in FIGS. 7, 9, and 10 an aperture comprising a transverse slot 50 is formed in the wall 30. Similarly, a transverse slot 51 is formed in the wall 31. The transverse slot 50 is of sufficient transverse width to receive the wafer retaining member 28 for inserting the legs 41, 43, and 44 in the cross section of the connector shell 13. In order to seat the first leg portion 40, a boss 52 is formed in the outer wall 30 along the back transverse sides of the slot 50. Preferably, the first leg 40 is dimensioned to fit within the slot 50 and over the boss 52. Similarly, a seating means in the form of a boss 53 is formed along the back and ends of the slot 51 in the wall 31. This is illustrated in FIG. 9, which is an elevational cross section taken along lines 9 — 9 of FIG. 7. In order to retain the wafer-retaining member 28 in the connector shell 13, first and second slots 58 and 59 are formed in the inner surface of the wall 30 for receiving forward ends of the legs 43 and 44 respectively. The slots 58 and 59 may be formed by providing a forward inner surface 61 parallel to and inwardly from a rear inner surface 62 of the wall 30. When the required geometry for maintaining the wafer retaining means 28 in the connector shell 13 is thus accomplished, the connector shell may be produced by casting. Therefore, expensive machining operations are avoided. Seating the first leg 40 on the boss 52 in the slot 50 locates the wafer retaining means 28 in the rear portion 47 of the connector shell 13 and properly aligns the legs 41, 43, and 44.

As indicated in FIG. 7, the wafer-retaining means 28 is inserted forwardly through the slots 50 as indicated by arrows in FIG. 7. The ends of the maintaining legs 43 and 44 respectively slide into the slots 58 and 59, and the first leg 40 seats within the slot 50 on the boss 52. The final position of the wafer-retaining means 28 is further illustrated in FIG. 13. The wafer retaining means 28 is preferably made of beryllium copper to provide both strength for retaining and to provide a degree of resilience for camming of the second leg 41 by a rib 72 (FIGS. 11 and 12) of the connector wafer 11. In production, the spring clip comprising the wafer retaining means 28 may simply be stamped. The second leg 41 is bent with respect to the first leg 40 so that when in the connector shell 13, the leg 41 is spring-biased against the connector wafer 11. The legs 43 and 44 may also be formed with a slight bend to provide a spring bias when inserted in the slots 58 and 59 tending to hold the wafer retaining means 28 in place.

In order to facilitate alignment of first and second connector wafers 11 and 12, an axially extending key 65 traversing the slot 50 is formed on the rear inner surface 62 of the wall 30 at the transverse center thereof. Similarly, keys 66 and 67 are provided extending axially in the rear portion of the inner surface of the wall 31. The keys 66 and 67 are preferably transversely equidistantly displaced from the key 65 and traverse the slot 51. The keys 65, 66 and 67 provide for desired orientation of the connector wafers 11 and 12 with respect to the connector shell 13, and may act as seating means for the wafer retaining means 28 and 38.

Figure 11:
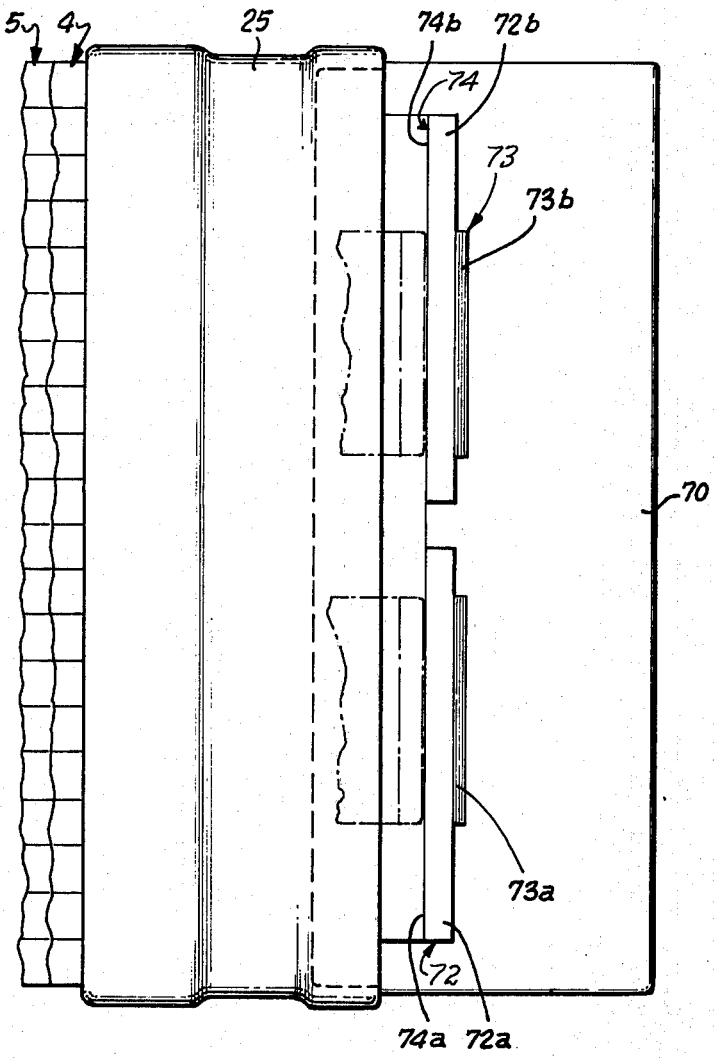
FIG. 11 is an elevation of connector wafers aligned for insertion in a connector shell.
Figure 12:
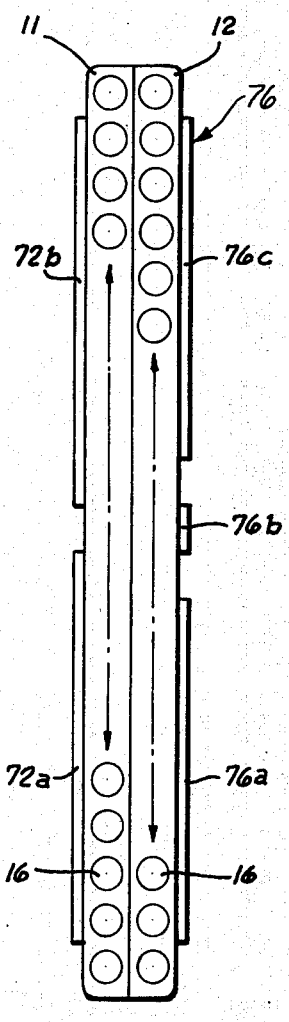
FIG. 12 is a frontal end view of the wafers of FIG. 11.

In FIGS. 11 and 12, the connector wafers 11 and 12 are illustrated in greater detail. The relative position of the leg portions 41*a* and 41*b* are shown in dotted line form. FIG. 11 is an elevational view similar to that of FIG. 1 illustrating the wafers 11 and 12, and FIG. 12 is a front end view. The connector wafer 11 is preferably of rectangular shape and has a front end 70 adjacent which the connector pins 16 are located. Terminating mean 25 at the rear thereof join the connector wafer 11 to the conductor group 4. The wafers 11 and 12 preferably have flat or interlocking inner surfaces mating at an interface 71. For purposes of retaining the wafer 11 in the connector shell 13, the connector wafer 11 has formed on an outer surface thereof a transverse rib 72 which may be bifurcated and in the present embodiment consists of rib sections 72*a* and 72*b*. The rib 72 preferably has a forward camming surface 73, illustrated as sections 73*a* and 73*b* and a square rear shoulder 74 illustrated as shoulder sections 74*a* and 74*b* on the rib section 72*a* and 72*b* respectively. The rib sections 72*a* and 72*b* define a recess comprising a keyway which is dimensioned to be in registration with the shell way 65. Similarly, on the connector wafer 12, a transverse rib 76 consisting of sections 76*a*, 76*b*, and 76*c* is provided similar to the transverse rib 72. However, the transverse rib 76 is dimensioned to have keyways in registration with the keys 66 and 67. This construction provides for retention, polarization and alignment of the wafers of 11 and 12 in the connector shell 13 as illustrated in FIG. 13.

FIG. 13 is an elevational sectional view taken along lines 13 — 13 of FIG. 1. In FIG. 13, the connector wafers 11 and 12 are shown in place in the connector shell 13. In their final position, the connector wafers 11 and 12 rest in the forward portion 46 of the connector shell 13, and the front end 42 of the leg 41 of the wafer retaining means 28 abuts the rear shoulder 74 of the transverse rib 72. The wafer-retaining means 38 acts similarly on the rib 76 to maintain the wafer 12 in position. The connector shell 13 and the wafers 11 and 12 and their respective ribs 72 and 76 are proportioned with respect to each other such that in order to achieve this desired disposition, the wafers 11 and 12 are placed with their flat surfaces together and inserted at the rear end 19 of the connector shell 13 in a forward axial direction. The connector wafers 11 and 12, the connector shell 13, wafer retaining means 28 and 38 are dimensioned such that the following operations result. As the connector wafers 11 and 12 are moved forward toward the engaging means 63 illustrated in FIG. 10 and FIG. 13 as a sloping surface adapted to coact with camming surface 73 of rib 72 and the corresponding camming surface of rib 76 to limit the forward movement of wafers 11 and 12, the ribs 72 and 76 respectively cam the retaining means 28 and 38, e.g. the rib 72 cams the second leg 41 of the wafer-retaining means 28. After the wafers 11 and 12 are in place, forward legs of the retaining means 28 and 38 spring back toward their original position, respectively coming to rest on the wafers 11 and 12 behind the ribs 72 and 76. In FIG. 13, removal of the wafers 11' and 12' is illustrated with respect to the connector half 3. The tool 15 is slid into a clearance 80' between the surface of the connector wafer 11' and the inner surface of the wall 30' of the connector shell 13'. Preferably a front end of the tool 15 is moved into abutment with the rear shoulder 74' of the rib 72'. This action frees the rear shoulder 74' of engagement with the leg 41' of the retaining means 28'. Consequently, the connector wafer 11' may be removed rearwardly. Consequently, the connector wafer 12' has more than adequate clearance to be removed from the connector shell 13'.

Figure 14:
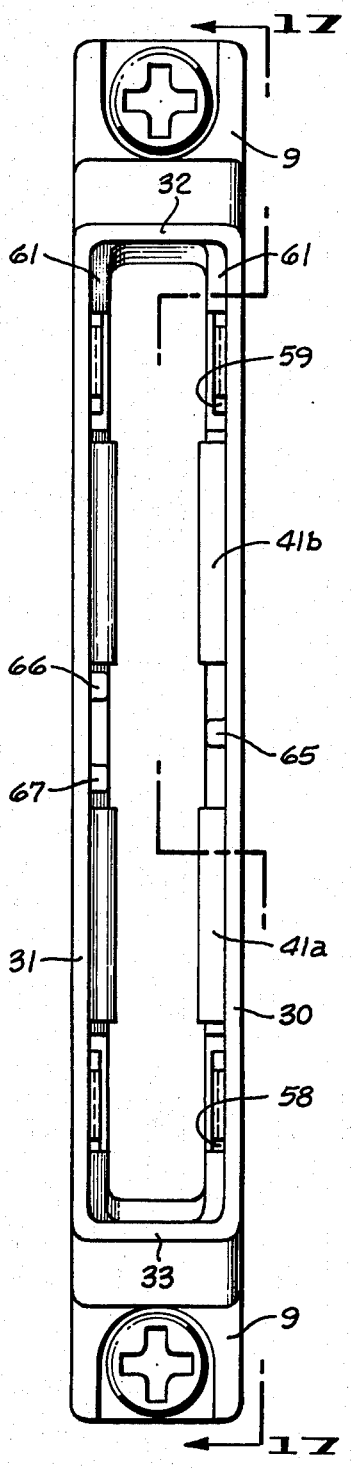
FIG. 14 is a rear end view taken along lines 14—14 of FIG. 16 and showing connector wafers included in a connector shell.
Figure 16:
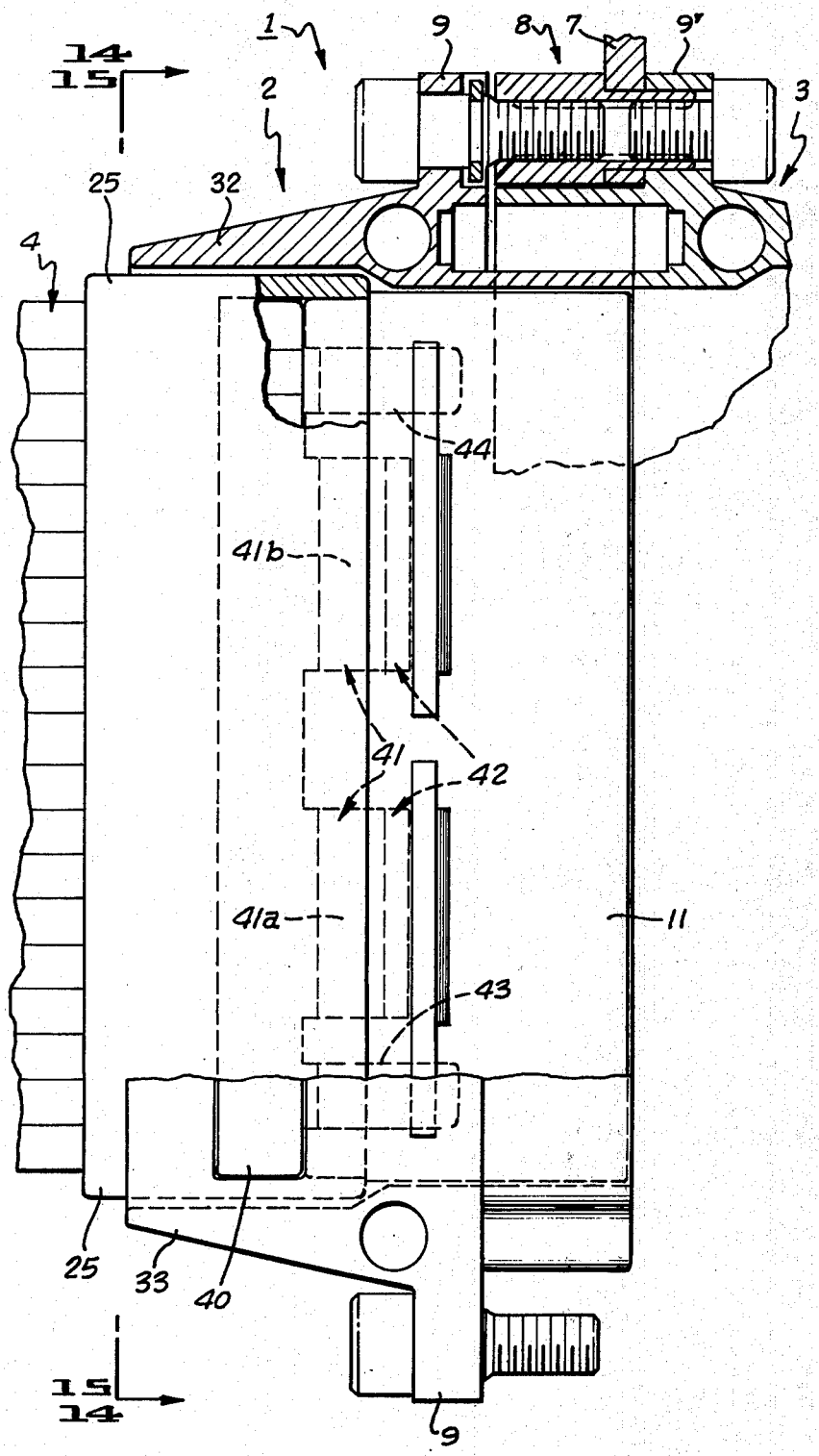
FIG. 16 is a detailed elevation of one connector half of FIG. 1, partially broken away.
Figure 15:
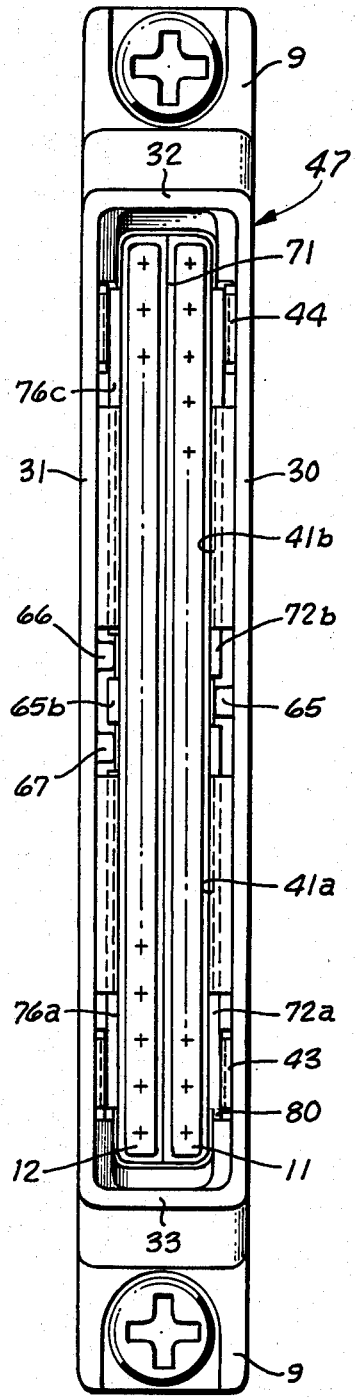
FIG. 15 is a rear end view along lines 15—15 of FIG. 16.

FIG. 14 is a rear end view of the connector shell 13 taken along lines 14—14 of FIG. 16 with the connector wafers 11 and 12 removed. The clearances in the preferred embodiment which provide for the most advantageous operation of the present invention are further illustrated with reference to FIG. 15, which is a rear end view of the connector shell 13 taken along lines 15 — 15 of FIG. 16 illustrating the connector wafers 11 and 12 in place in the connector shell 13. FIG. 15 is a rear end view of connector shell 13 along lines 15—15 of FIG. 16. The rear section 47 of the connector shell 13 is formed having a width in the longitudinal direction between the inner surfaces of the walls 30 and 31 sufficient to accept the combined longitudinal width of the wafers 11 and 12 and the ribs 72 and 76. (The horizontal direction in FIGS. 14 and 15 is longitudinal.) The forward inner walls 61 of the walls 30 and 31 are illustrated and have a width suffficient to accommodate the connector wafers 11 and 12, but a width insufficient to allow clearance of the connector wafers 11 and 12 and the ribs 72 and 76. The second legs 41 of the retaining means 28 and 38 project into the cavity defined by the connector shell 13. Therefore, when the connector wafers are inserted, as illustrated in FIG. 15, the front legs 41 are cammed and then come to rest behind the ribs 72 and 76 (see also FIG. 13). The rear ends of the forward inner walls 61 act as engaging means 63 to limit forward motion of the connector wafers 11 and 12 in the connector shell 13. Many other surfaces in the connector shell could be provided as engaging means to abut the same or another portion of the connector wafer 11 or 12.

Figure 17:
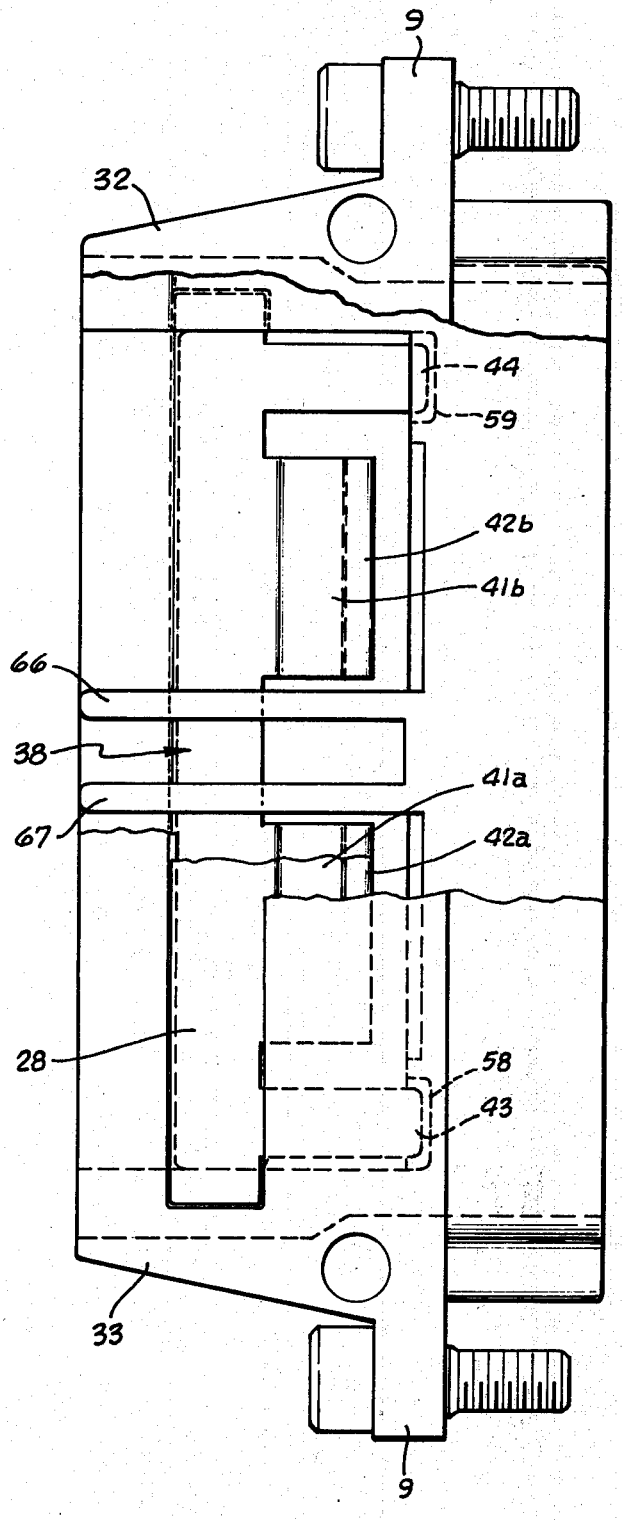
FIG. 17 is an elevational section view of one connector half of FIG. 1 taken along lines 17—17 of FIG. 14.

FIGS. 16 and 17 illustrate further relationships within the connector shell 13. As seen in FIG. 16, in which the connector shell 13 is broken away to show the rib sections **72*a* and 72*b*, interaction of the spring retaining means with the rib 72 is better illustrated. FIG. 17 is broken away to illustrate the keys 66 and 67 and to illustrate the projection of the retaining means 38 from the boss 53 into the cavity of the connector shell 13**.

The above described invention is advantageous in that the beryllium copper retaining means 28 and 38 provide reliable and strong maintaining of the connector wafers 11 and 12 in place, while allowing for simple and quick removal with the tool 15. The connector half of the present invention is designed so that fewer parts are involved than in many other well-known constructions of connector halves to provide the same installation and removal of connector wafers in a connector shell. Furthermore, the ribs on the connector wafers serve not only as retaining means but also as keyway registration means. All of the above functions may be accomplished in a connector shell which is cast. Therefore, the present invention provides maximum utility at reduced cost. Of course, many modifications may be made in the specific embodiments disclosed to provide a connector system constructed in accordance with the above teachings.

What is claimed as new and desired to be secured by Letters Patent of the United States is:

1. In a connector half including a connector shell of the general type having first and second parallel, transverse faces joined by perpendicular side walls to provide a substantially rectangular cross section, said transverse walls having inner and outer faces, said connector shell having a forward portion and a rear portion and having a front end for mating with another connector half and having a rear end, and further comprising a connector wafer of substantially the same rectangular cross section of said connector shell, said connector wafer including connector contacts at a front end thereof, said connector wafer being for disposition such that said connector contacts are adjacent said front end of said connector shell, the improvement comprising, in combination:

resilient retaining means comprising a spring clip having a first transversely disposed leg mounted to said connector shell and a second, forward leg of substantially flat and rectangular shape cantilevered therefrom, said forward leg being contilevered from a point on an interface of one of said transverse walls and extending forwardly and into a cavity defined by said transverse walls and said side walls toward the front of said connector shell;

an aperture located in the rear portion of one of said transverse walls of said connector shell for insertion of said spring clip therein, and further in which seating means are provided in said connector shell for locating said first leg of said spring clip and aligning said second forward leg of said spring clip within said connector shell;

engaging means formed in said connector shell for limiting the forward movement of said connector wafer therein;

a transverse rib formed on a surface of said connector wafer facing an inner surface of said connector shell, said transverse rib comprising a forward camming surface and a rear shoulder, said transverse rib and said resilient means and said engaging means being disposed with respect to each other such that when said wafer is inserted in said connector shell in an axial direction, said forward camming surface cams the leg of said resilient retaining means, and in a final position in which said engaging means engages said wafer preventing forward movement thereof, said leg of said resilient retaining means is positioned behind said rear shoulder of said transverse rib such that upon a predetermined amount of rearward motion of said wafer, the end of said resilient retaining means engages said rear shoulder of said transverse rib, whereby said wafer is retained in said connector shell.

2. The improvement of claim 1 wherein said spring clip further comprises first and second retaining legs projecting from said first leg of said spring clip, and wherein retaining slots are formed on the inner surface of said connector shell forwardly of said aperture, said retaining legs being retained in said slots for maintaining said spring clip in position in said connector shell.

3. The improvement of claim 2 wherein said connector shell further comprises a key extending axially along and projecting inwardly from the rear portion of the inner face of said transverse wall, whereby an upper surface of said key traverses said aperture and comprises seating means for the first leg of said spring clip and wherein said forward leg of said spring clip is bifurcated to provide a recess in said forward leg of said spring clip in registration with said key, and further wherein said transverse rib on said wafer is provided with a recess in registration with said key, whereby said transverse rib acts as both keyway registration means and retaining means.

4. The improvement according to claim 2 wherein said retaining slots are defined by the inner surface of said transverse face and an upper surface of a second inner wall parallel to said inner surface of said transverse face, whereby said connector shell may be formed by casting, and further wherein said wafer is dimensioned to fit the recess defined by said second inner wall.

5. The improvement according to claim 4 wherein said engaging means for engaging said wafer comprises said second inner wall, and wherein said forward camming surfaces of said transverse rib engages a rear edge of said second inner wall.

6. The improvement according to claim 1 wherein said connector assembly includes first and second wafers for insertion into said connector shell, each wafer having an inner face for engagement with the inner face of the other wafer, and each wafer having an outer face having said transverse rib formed thereon.

7. The improvement according to claim 6 wherein said resilient retaining means comprises first and second spring clips each, having a transversely disposed first leg fixed to a rear portion of said inner face one transverse wall of said connector shell and each having a second forward leg of substantially flat and rectangular shape.

8. The improvement according to claim 7 wherein each of said transverse walls includes axial slots formed parallel to the inner face of said transverse wall and said spring clip further comprises first and second retaining legs projecting from said first leg of said spring clip, said retaining legs being retained in said slots for maintaining said spring clip in position in said connector shell.

9. The improvement according to claim 8 wherein each transverse wall is provided with an axially extended key, the key on said first and second inner faces being transversely displaced with respect to each other, and further wherein at least one recess is provided in each traverse rib on each of said wafers in registration with the key on one of said inner faces of said transverse walls.

* * * * *